US005617723A

United States Patent [19]

Hosseini et al.

[11] Patent Number: 5,617,723

[45] Date of Patent: Apr. 8, 1997

[54] METHOD FOR CONTROLLING AN IMPLEMENT OF A WORK MACHINE

[75] Inventors: Javad Hosseini, Edelstein; Nathan T. Schenkel, Coal City; James E. Schimpf, Plainfield, all of Ill.

[73] Assignee: Caterpillar Inc., Peoria, Ill.

[21] Appl. No.: 563,478

[22] Filed: Nov. 28, 1995

Related U.S. Application Data

[63] Continuation of Ser. No. 331,449, Oct. 31, 1994, Pat. No. 5,537,818.

[51] Int. Cl.[6] ..... F16D 31/00; F16D 39/00

[52] U.S. Cl. ..... 60/327; 60/459; 91/361; 91/435

[58] Field of Search ..... 60/459, 327; 91/361, 91/459, 461, 511, 435

[56] References Cited

U.S. PATENT DOCUMENTS

| | | | |
|---|---|---|---|
| 3,789,739 | 2/1974 | Krehbiel et al. | 91/358 |
| 3,892,079 | 7/1975 | Hirano et al. | 37/56 |
| 4,015,729 | 4/1977 | Parquet et al. | 214/138 |
| 4,109,812 | 8/1978 | Adams et al. | 214/762 |
| 4,166,506 | 9/1979 | Tezuka et al. | 172/4.5 |
| 4,358,989 | 11/1982 | Tordenmalm | 91/361 |
| 4,552,503 | 11/1985 | Mouri et al. | 414/687 |
| 4,643,074 | 7/1987 | Gunda et al. | 91/361 |
| 4,844,685 | 7/1989 | Sagaser | 414/700 |
| 4,893,981 | 1/1990 | Yoshinada et al. | 414/5 |
| 5,102,102 | 4/1992 | Hidaka et al. | 91/361 X |
| 5,189,940 | 3/1993 | Hosseini et al. | 91/361 |
| 5,195,864 | 3/1993 | Drake et al. | 60/469 X |
| 5,333,533 | 8/1994 | Hosseini | 91/361 |

FOREIGN PATENT DOCUMENTS 2225127 5/1990 United Kingdom .

*Primary Examiner*—Hoang Nguyen
*Attorney, Agent, or Firm*—James R. Yee

[57] ABSTRACT

A method for controlling an apparatus (100) for controllably moving an implement (102) is provided. The implement (102) is connected to a work machine (104) and is movable between first and second implement positions in response to operation of a hydraulic actuator (106). The apparatus (100) includes a joystick (306) with first and second positions and a neutral position. The joystick (306) is normally biased in a neutral position and is movable between the first and second positions. The apparatus senses the position of the joystick (306) and responsively generates a joystick position signal. The joystick (306) maintained at the first and second detent positions in response to manual movement of the joystick to the respective first and second detent positions. The joystick (306) is released from the detent position in response to receiving a release detent signal. The apparatus (100) senses the position of the work implement (102) with respect to the work machine (104). The apparatus (100) provides hydraulic fluid flow to the hydraulic actuator (106) in response to a magnitude of an electrical valve signal. The apparatus (100) receives the joystick position signal, responsively delivers the electrical valve signal. The magnitude of the electrical valve signal is proportional to the joystick position signal. The apparatus (100) compares the implement position signal with a first detent position and a second detent position and responsively produces the release detent signal.

1 Claim, 9 Drawing Sheets

METHOD FOR CONTROLLING AN IMPLEMENT OF A WORK MACHINE

This is a Continuation of Application Ser. No. 08/331,449 filed Oct. 31, 1994 now U.S. Pat. No. 5,537,818.

TECHNICAL FIELD

This invention relates generally to an apparatus for controlling the extension and retraction of a hydraulic cylinder and, more specifically, to an apparatus for providing quiet, more flexible, and easier to operate implement control.

BACKGROUND ART

Work machines such as wheel type loaders include work implements capable of being moved through a number of positions during a work cycle. Such implements typically include buckets, forks, and other material handling apparatus. The typical work cycle associated with a bucket includes sequentially positioning the bucket and associated lift arm in a digging position for filling the bucket with material, a carrying position, a raised position, and a dumping position for removing material from the bucket.

Control levers are mounted at the operator's station and are connected to a hydraulic circuit for moving the bucket and/or lift arms. The operator must manually move the control levers to open and close hydraulic valves that direct pressurized fluid to hydraulic cylinders which in turn cause the implement to move. For example, when the lift arms are to be raised, the operator moves the control lever associated with the lift arm hydraulic circuit to a position at which a hydraulic valve causes pressurized fluid to floe to the head end of a lift cylinder, thus causing the lift arms to rise. When the control lever returns to a neutral position, the hydraulic valve closes and pressurized fluid no longer flows to the lift cylinder.

In normal operation, the implement is often brought to an abrupt stop after performing a given work cycle function. This can occur, for example, when the implement is moved to the end of its range of motion. If the lift arms or hydraulic cylinders impact with a mechanical stop, significant forces are absorbed by the lift arm assembly and the hydraulic circuit. This results in increased maintenance and accelerated failure of associated parts.

A similar situation occurs when a control system holds the control lever in a detent position at which the associated hydraulic valve is held open until the lift arm assembly or implement reaches a predetermined position. The springs quickly move the control lever to the neutral position which in turn abruptly closes the associated hydraulic valve. Thus, the lift arm assembly and/or bucket is brought to an abrupt stop. Such abrupt stops result in stresses being exerted on the hydraulic cylinders and implement linkage from the inertia of the bucket, lift arm assembly, and load. The abrupt stops also reduce operator comfort and increase operator fatigue.

Stresses are also produced when the vehicle is lowering a load and operator quickly closes the associated hydraulic valve. The inertia of the load and implement exerts forces on the lift arm assembly and hydraulic system when the associated hydraulic valve is quickly closed and the motion of the lift arms is abruptly stopped. Such stops cause increased wear on the vehicles and reduce operator comfort. In some situations, the rear of the machine can even be raised off of the ground.

To reduce these stresses, systems have been developed to more slowly and smoothly stop the motion of the implement in these situations. One solution to this problem is disclosed in U.S. Pat. No. 4,109,812, issued to Adams at al on Aug. 29, 1978. A device is provided for halting the flow of hydraulic fluid to the cylinders just prior to the lifts arms reaching the end of their range of motion and trapping fluid within the cylinder to act as a hydraulic cushion. While this approach is acceptable for slowing the implement does before it reaches a mechanical stop, this device is not readily adapted to use with a control system, that stops the implement at adjustable kickout positions. Such kickout positions are chose in response to the parameters of the work cycle and are typically different from the maximum raise and lower positions. Such a hydraulic cushion is also not readily controllable in response to changes in operating conditions.

An alternative system is disclosed in U.S. Pat. No. 4,358,989, issued to Tordenmalm in Nov. 16, 1982. This system utilizes an electrohydraulic valve to extend and retract a position within a hydraulic cylinder. When the piston reaches a position that is a predetermined distance from the end of stroke, the control system progressively closes the electrohydraulic valve as the piston continues to move toward the end of stroke. While this system adequately reduces the velocity of the piston before it reaches a hard stop, it is not operable to perform other desirable implements, such as adjustable kickout positions and defining multiple raise kickout positions. Also, if the electronic system fails the operator is unable to operate the hydraulic cylinders.

Another problem associated with hydraulic implement control systems is noise. Much work has been done to insulate the operator from outside noise. Enclosed cabs and sound proofing have insulated the operator from much of the noise. However external sources, such as the engine, are not the only noise sources. Hydraulic control systems include a hydraulic circuit formed by at least one hydraulic pump, a control lever, at least one control valve, an actuator such as a hydraulic cylinder, and a reservoir. The control lever operates the valve which controllably provides hydraulic fluid to the actuator. Typically, the hydraulic fluid flow must be routed near the control lever, i.e., in the operator's cab. This adds noise (originating from the hydraulic pump) to the cab's interior.

Another problem associated with the control lever is that the operator via movement of the control lever is physically actuating the valve. The valve may either directly control flow to the actuator or may be part of a pilot system which indirectly controls flow via a second valve. Either way, movement of the control lever requires a lot of effort which may quickly tire the operator who must consistently operate the system through its work cycle.

The present invention is directed to overcoming one or more of the problems set forth above.

SUMMARY OF THE INVENTION

In one aspect of the present invention, an apparatus for controllably moving an implement is provided. The implement is connected to a work machine and is movable between first and second implement positions in response to operation of a hydraulic actuator. The apparatus 100 includes a joystick 306 with first and second positions and a neutral position. The joystick is normally biased in a neutral position and is movable between the first and second positions. The apparatus senses the position of the joystick and responsively generates a joystick position signal. The joystick maintained at the first and second detent positions in response to manual movement of the joystick to the respective first and second detent positions. The joystick is released from the detent position in response to receiving a release detent signal. The apparatus senses the position of the work implement with respect to the work machine The apparatus provides hydraulic fluid flow to the hydraulic actuator in response to a magnitude of an electrical valve signal. The apparatus receives the joystick position signal, responsively delivers the electrical valve signal. The magnitude of the electrical valve signal is proportional to the joystick position signal. The apparatus compares the implement position signal with a first detent position and a second detent position and responsively produces the release detent signal.

BEST MODE FOR CARRYING OUT THE INVENTION

Figure 1:
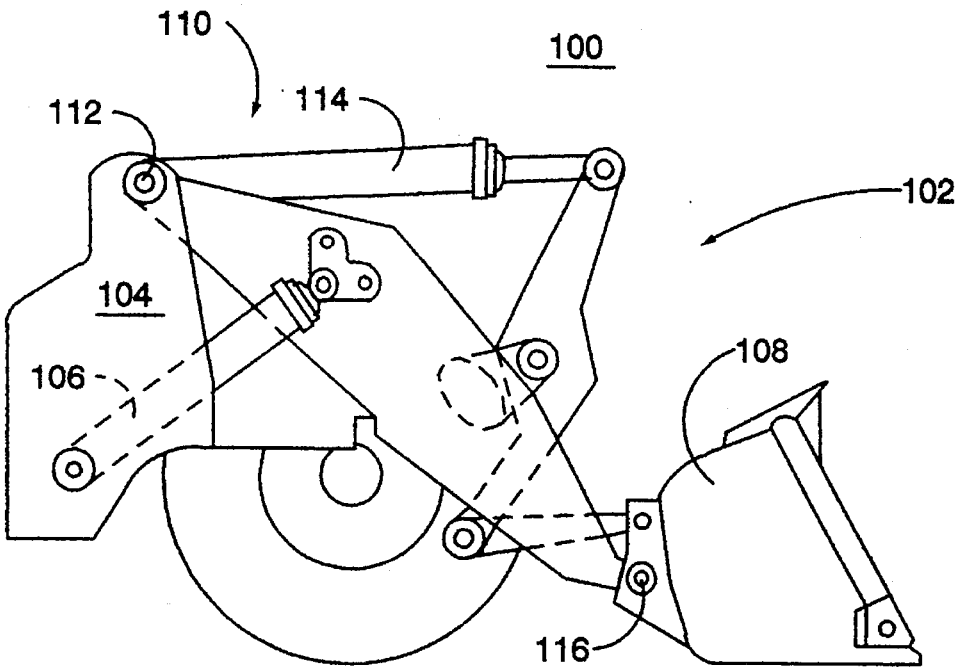
FIG. 1 is a side view of the forward portion of a loader machine or wheel type loader.

With reference to FIG. 1, the present invention, an implement control system or apparatus 100 for controllably moving a work implement 102 between first and second implement positions, is generally represented by the element number 100. Although FIG. 1 shows a forward position of a wheel type loader machine 104 having a payload carrier in the form of a bucket 108, the present invention is equally applicable to machines such as track type loaders, hydraulic excavators, and other machines having similar work implements. The bucket 108 is connected to a lift arm assembly 110, which is pivotally actuated by two hydraulic lift cylinders or actuators 106 (only one of which is shown) about a pair of lift arm pivot pins 112 (only one of which is shown) attach to the machine frame. The bucket 108 can also be tilted by a bucket tilt cylinder 114 about a tilt pivot pin 116.

Figure 2:
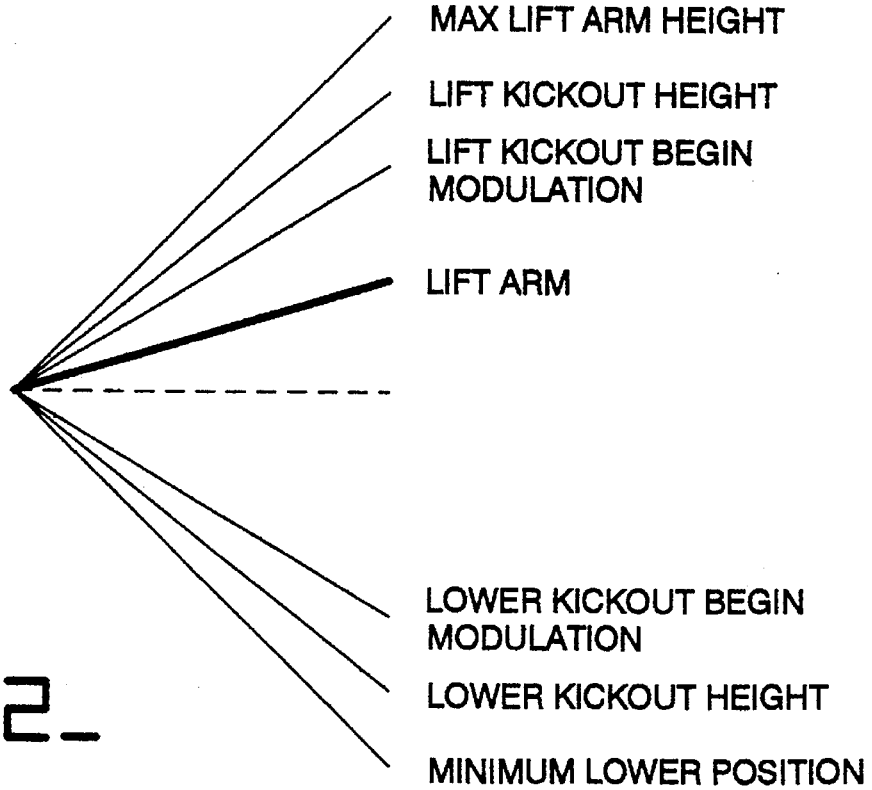
FIG. 2 illustrates a plurality of positions through which the lift arms of a work machine are moved.

FIG. 2 diagrammatically illustrates the range of motion of the lift arm assembly 110 and a plurality of intermediate positions through which the lift arm assembly is moved during a work cycle. The maximum lift arm height is the position of the lift arm assembly 110 at which a mechanical stop prevents the lift cylinders 106 from further raising the bucket 108. Similarly, the minimum lower position is the position at which a mechanical stop prevents the lift cylinders 106 from further lowering the bucket 108. A midpoint is shown generally by a dashed line and substantially bisects the range of motion of the lift arm assembly 110 which is defined by the maximum lift arm height and the minimum lower position.

The lift and lower kickout heights illustrate positions to which the lift arm assembly 110 is to be moved while performing a work cycle. For example, the lift kickout height corresponds to the desired dump height for the bucket 108, and the lower kickout height corresponds to the return-to-dig position for the bucket 108. Advantageously, the lift and lower kickout heights can be selected by the operator at the beginning of a work cycle and are changeable in response to the parameters of the particular work cycle being performed.

The lift and lower kickout begin-modulation-positions correspond to the positions of the lift arm assembly 110 at which the implement control system 100 begins to reduce the speed of the bucket 108. The begin-modulation-positions are advantageously selected to allow the implement control system to completely stop the bucket 108 at the appropriate kickout height without unduly stressing the lift arm assembly 110 or reducing operator comfort.

Figure 3:
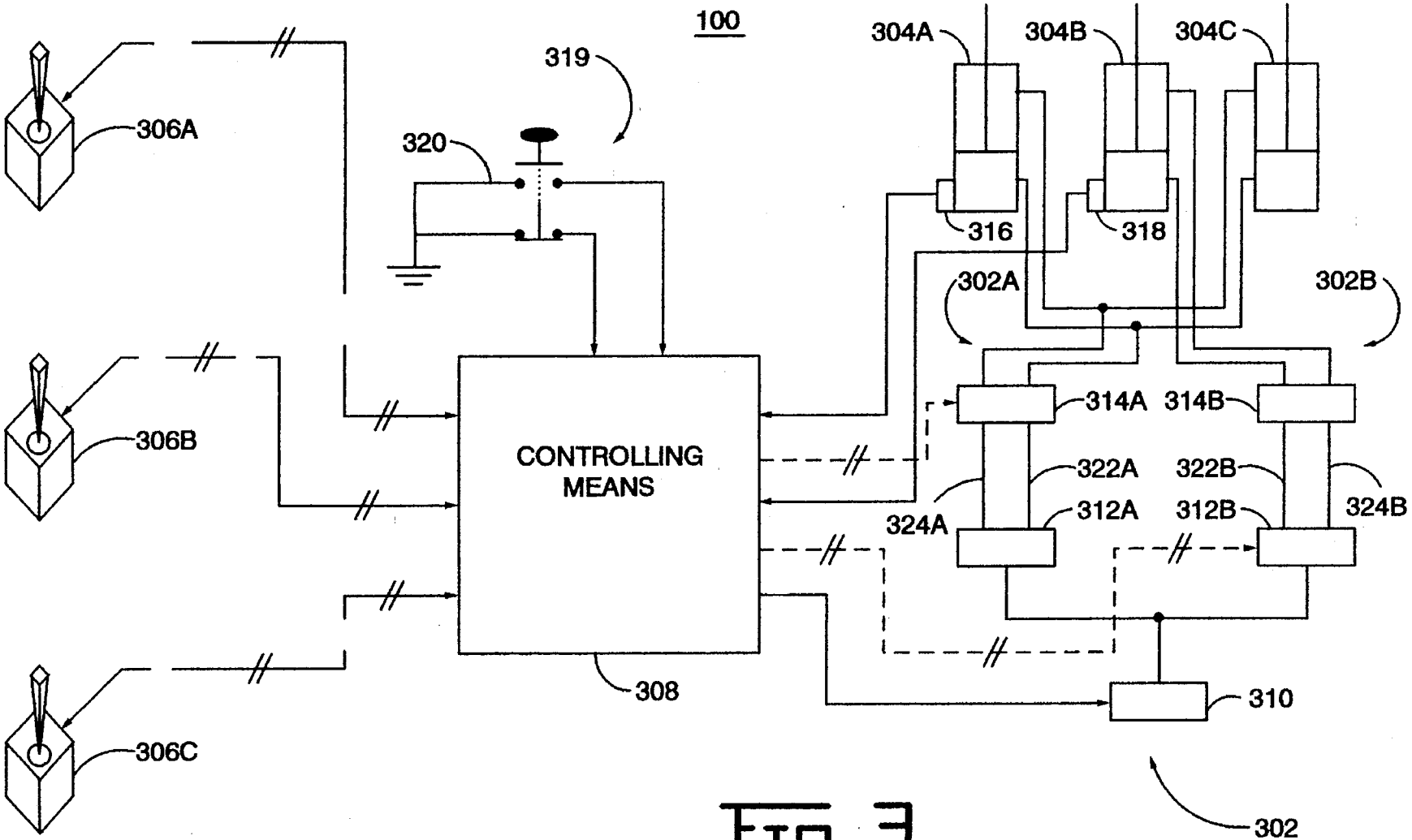
FIG. 3 is a diagrammatic illustration of a first embodiment of the present invention.

With reference to FIG. 3, a first embodiment of the implement control system 100 as applied to a wheel type loader is diagrammatically illustrated. The control system is adapted to sense a plurality of inputs and responsively produce output signals which are delivered to various actuators in the control system. The control system provides full electronic implement control. Preferably, the control system includes a microprocessor based controlling means 308.

First, second, and third joysticks 306A,306B,306C provide operator control over the work implement 104. The first joystick 306A controls the lifting operation of the lift arm assembly 110. The second joystick 306B controls the tilting operation of the bucket 108. The third joystick 306C controls an auxiliary function, such as operation of a special work tool. The joysticks are not hydraulic control levers, that is, they are not directly connected to a hydraulic circuit nor are hydraulic control valves directly actuated. The position of each joystick 306 is sensed and an electrical signal is produced and delivered to the controlling means 308. The controlling means 308 controls the hydraulic system. This allows the joysticks to be separate from the hydraulic system. Thus, the hydraulic pumps and hydraulic feed lines can be placed away from the joysticks and thus the operator. This results in a quieter cab environment. Since no hydraulic valves are being actuated, the effort required to actuate the joystick is less, resulting in less operator fatigue.

All three joystick 306 operate in a similar manner, thus, only operation of the lift joystick 306A is discussed.

Figure 6:
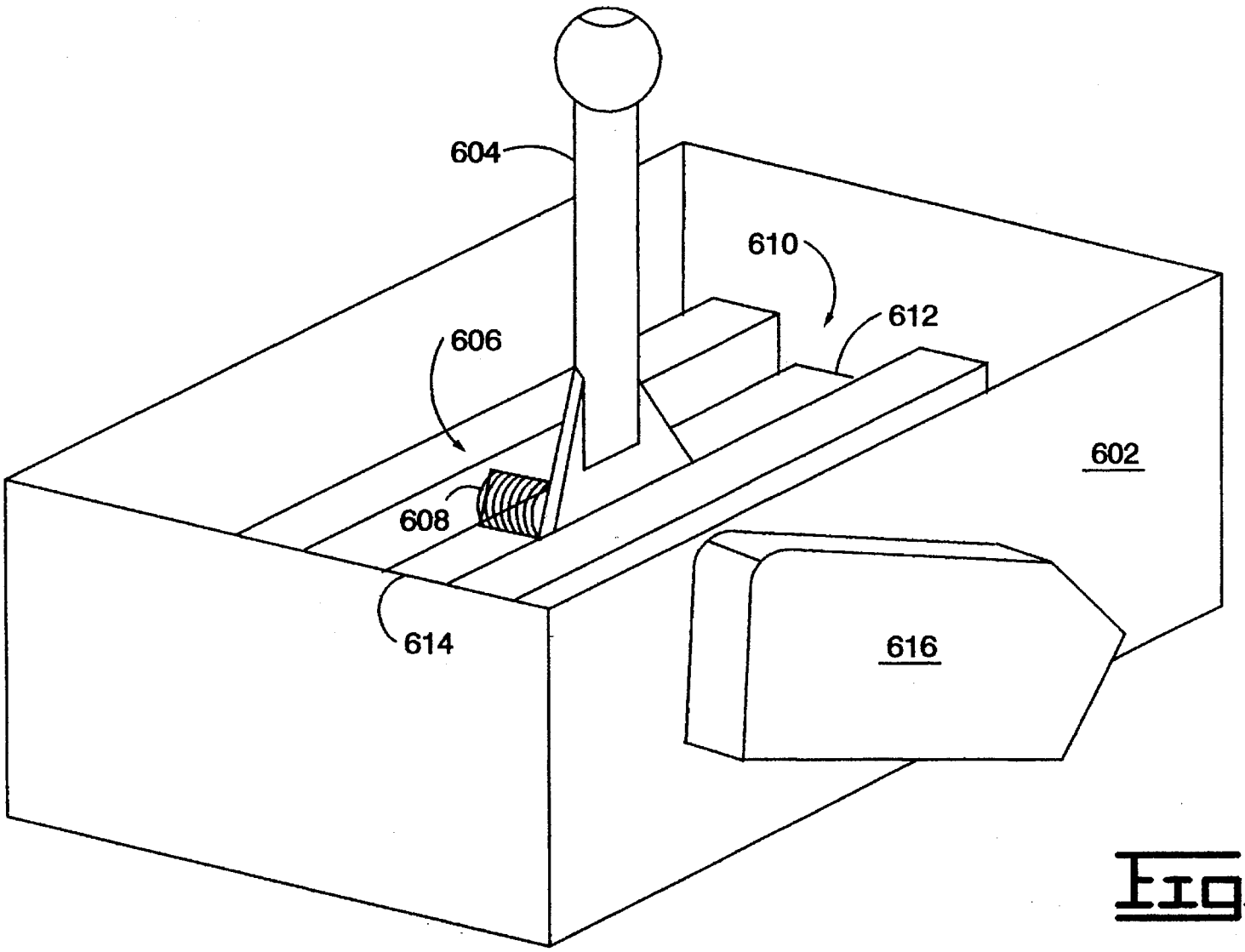
FIG. 6 is an illustration of a joystick, according to an embodiment of the present invention.

The lift joystick 306 includes first and second detent positions and a neutral position. In the preferred embodiment, the first and second detent positions correspond to a raise detent position and a lower detent position. With reference to FIG. 6, the joystick 306 includes a housing 602 and a control lever 604. The control lever 602 is pivotally movable in directions along the housing. The raise detent position is at one end of the lever's movement and the lower detent position is at the other end of the lever's movement. The neutral position is vertical. The joystick 306 allows movement of the lever 604 past the detent positions.

A biasing means 606 maintains the control lever 604 in the neutral position when no force is being applied to the lever 604. The biasing means 606 preferably includes a spring 608.

A joystick position sensing means 616 senses the position of the control lever 604 and responsively generates an electrical joystick position signal. The electrical signal is delivered to an input of the controlling means 308. The joystick position sensing means 616 preferably includes a rotary potentiometer which produces a pulse width modulated signal in response to the pivotal position of the control lever 604; however, any sensor that is capable of producing an electrical signal in response to the pivotal position of the control lever would be operable with the instant invention.

A detent means 610 maintains the joystick 306 at the raise and lower detent positions in response to manual movement of the joystick to the respective joystick detent position. In the preferred embodiment, the detent means 610 includes first and second electrohydraulic solenoids 612,614 which are responsive to electrical signals from the controlling means 308. The solenoids are designed to provide only enough force to overcome the biasing means 606 and maintain the levers in the detent positions. Thus, if the operator applies an opposite force the control lever moves.

The control lever described above has movement along a single axis. However, it should be recognized that other type of control levers are easily adaptable to the present invention. For instance, in addition to movement along a first axis (horizontal), the control lever might also move along a second axis which is perpendicular to the horizontal axis.

A position sensing means 304 senses the position of the work implement 102 with respect to the work machine 104 and responsively produces an implement positions signal. In the preferred embodiment, the position sensing means 304 includes a lift position sensing means 316 for sensing the position of the lift arm assembly 314 and a tilt position sensing means 318 for sensing the position of the bucket 108. In one embodiment, the lift and tilt position sensing means 316,318 include rotary potentiometers. The rotary potentiometers are adapted to produce pulse width modulated signals in response to the angular position of the lift arms with respect to the vehicle and the bucket 108 with respect to the lift arm assembly 110. Since the angular position of the lift arms is a function of lift cylinder extension, the signal produced by the rotary potentiometer in the lift position sensing means 316 is a function of lift cylinder extension. Similarly, since the angular position of the bucket 108 is a function of tilt cylinder extension, the signal produced by the rotary potentiometer in the tilt position sensing means 308 is a function of tilt cylinder extension. The functions of the sensing means 316,318 can readily be any other sensor which are capable of measuring, either directly or indirectly, the relative extension of a hydraulic cylinder. For example, the potentiometers could be replaced with radio frequency (RF) sensors disposed within the hydraulic cylinders 304.

A valve means 302, responsive to electrical valve signals, controllably provides hydraulic fluid flow to the hydraulic actuators 304. In the first embodiment, the lift arm assembly 110 includes lift and right lift hydraulic cylinders 304A, 304C and a tilt hydraulic cylinder 304B.

In the preferred embodiment, the valve means 302 includes an electrohydraulic pilot supply valve 310. The electrohydraulic pilot supply valve 310 is electrically connected to the controlling means 308 and adapted to receive electrical output signals from the controlling means 308. The electrohydraulic pilot supply valve 310 is hydraulically coupled to a pilot supply source (not shown) and the rest of the valve means 302. The pilot supply valve 310 is preferably a normally closed on/off pilot valve and is included to control pilot fluid flow. The controlling means 308 is adapted to normally maintain the pilot supply valve 310 in an energized or open state in which pressurized fluid is directed to the rest of the valve means 302. The controlling means 308 is further adapted to de-energize or close the pilot supply valve 310 in response to preselected fault conditions, thereby stopping the flow of pilot fluid flow.

A first portion 302A of the valve control means 302 controls operation of the left and right lift cylinders 304A, 304C. A second portion 302B of the valve control means 302 control operation of the tilt hydraulic cylinder 304B. The first and second portions 302A,302B are substantially identical, and thus, only the first (lift) portion will be discussed. The second (tilt) portion operates in a similar manner. A third portion (not shown) controls operation of the auxiliary function.

The first portion 302A of the valve means 302 includes an electrically actuated pilot valve 312A connected to a pilot supply source (not shown) via the pilot supply valve 310. A main control valve 314A couples the electrically actuated pilot valve 312A to the hydraulic actuators 304A,304C.

Preferably, the electrically actuated pilot valve 312A is of the proportional type as are common in the art. The electrically actuated pilot valve 312 is continuously variable between fully opened at which the resulting electrohydraulic pilot pressure directed toward the main control valves is at maximum pilot pressure and a closed position at which the pilot pressure is substantially zero. The degree the electrically actuated pilot valve 312A is opened is dependent upon the magnitude of the electrical signal received from the controlling means 308. The pilot pressure from the pilot control valve 312A is directed to the main control valve 314A. The pilot pressure valve 312A is coupled to a raise input port 322A and a lower input port 324A of the main control valve 314A. The pilot pressure valve 312A is adapted to direct pilot pressure to one of the input ports 322A,324A dependent upon the signals from the controlling means 308.

The main control valve 314A is further hydraulically coupled to a hydraulic pump (not shown) for receiving a supply pressure therefrom. The main valve 314A has raise and lower output ports, respectively connected to the head and rod ends of the lift cylinders 304A,304C. The main valve 314A operates on the supply pressure to controllably direct pressurized fluid to the head end and rod end of the lift cylinders 304A,304C.

Similarly, the second (tilt) portion of the valve means 302, includes a second pilot pressure valve 312B under control of the controlling means 308. A second main control valve 314B is coupled between the second pilot pressure valve 312B and the tilt cylinder 304B. The second pilot pressure valve 312B directs pilot pressure to either a first input port 322B or a second input port 324B of the second main control valve 314B. The second main control valve 314B is further hydraulically coupled to a hydraulic pump (not shown) for receiving a supply pressure therefrom. The second main valve 314B has raise and lower output ports, respectively connected to the head and rod ends of the tilt cylinder 304B. The second main valve 314B operates on the supply pressure to controllably direct pressurized fluid to the head end and rod end of the tilt cylinders 304B.

At least one kickout switch 320 allows the kickout positions to be defined. The kickout switch 320 is electrically coupled to the controlling means 308. The kickout switch 320 delivers an electrical signal to the controlling means 308 when actuated. The controlling means 308 can thereby define new detent kickout positions based on the current lift arm and bucket positions. In one embodiment, a single kickout switch sets both lift arm and bucket kickouts. In another embodiment, two kickout switches are used.

Figure 4:
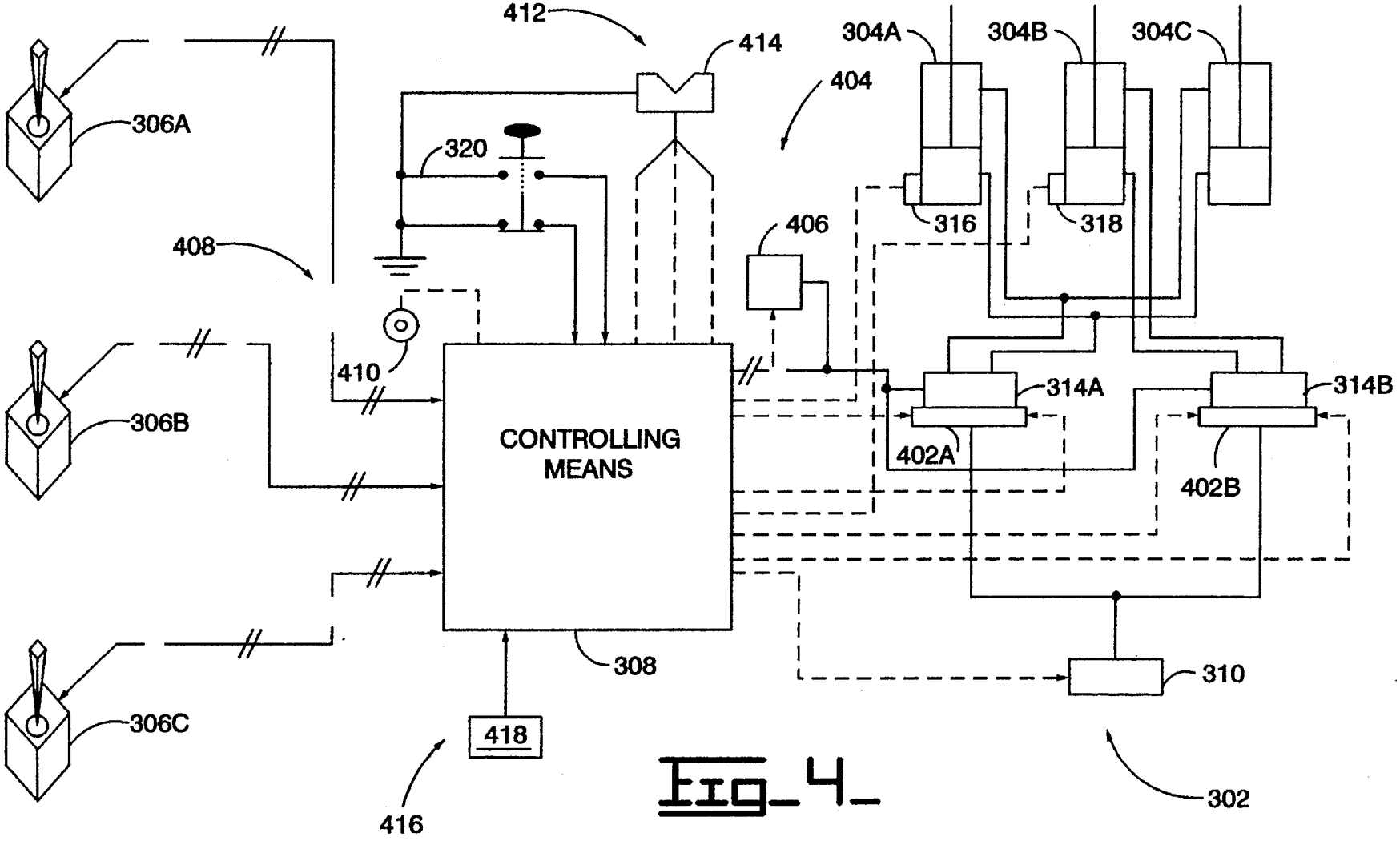
FIG. 4 is a diagrammatic illustration of a second embodiment of the present invention.

A second embodiment of the present invention is illustrated in FIG. 4. In FIG. 4, elements similar to those in FIG. 3 are numbered the same. Additionally, FIG. 4 illustrates features of the present invention (described below) equally applicable to the first and second embodiments.

The valve means 302 includes first and second portions 302A,302B for the lift cylinders 304A,304B and the tilt cylinder 304B, respectively. An ON/OFF pilot pressure supply valve 310 controls pilot pressure to first and second HYDRAC valves 402A,402B. The HYDRAC valves 402A, 402B are coupled to the first and second main control valves 314A,314B. The main control valves 314A,314B direct pressurized hydraulic fluid to the cylinders as described above. An exemplary HYDRAC valve is disclosed in U.S. patent application Ser. No. 08/090,375, filed Jul. 6, 1993 by Stephen V. Lunzman (Attorney Docket No. 93-206).

A means 404 coupled between the source of pressurized hydraulic fluid (pump) and the main control valves 314A, 314B varies the maximum hydraulic fluid flow to the main control valves 314A,314B. In the preferred embodiment, the hydraulic fluid flow varying means 404 includes a variable torque pump 406. The variable torque pump 406 is electrically coupled to the controlling means 308 and receives electrical signals from the controlling means 308. The variable torque pump 406 receives an ON/OFF command and a proportional command. The pump 406 in response to the OFF command allows maximum fluid flow to pass to the main control valves 314A,314B. In response, to the ON command, the pump 406 varies the proportion of fluid flow passed to the main valves 314A,314B.

Two additional means allows operator control of the variable torque pump 406. A load input means 412 sets the controlling means 308 in a carrying mode or a loading mode. In the preferred embodiment, the load input means 412 includes a rocker switch 414. The rocker switch 414 has at least two positions: a load position and a carry position. The rocker switch 414 is electrically coupled to the controlling means 308 and delivers respective load and carry signals to the controlling means 308. In response to receiving the load signal, the controlling means 308 sets the variable torque pump 406 to 80% maximum torque. In response to receiving the carry signal, the carrying means 308 sets the variable torque pump 406 to 100% maximum torque.

A variable input means 408 includes a rotary dial 410. The rotary dial 410 has a plurality of discrete positions (for example, 10). The rotary dial 410 is electrically coupled to the controlling means 308 and delivers a rotary dial position signal to the controlling means 208. The controlling means 308 includes a torque ratio associated with each position and in response to the dial 410 being in a respective position, controls the variable torque pump 406.

An engine speed sensing means 416 senses the rotary speed of the engine output shaft and responsively produces an engine speed signal. The engine speed signal is delivered to the controlling means 308 and is used as described below.

Figure 7:
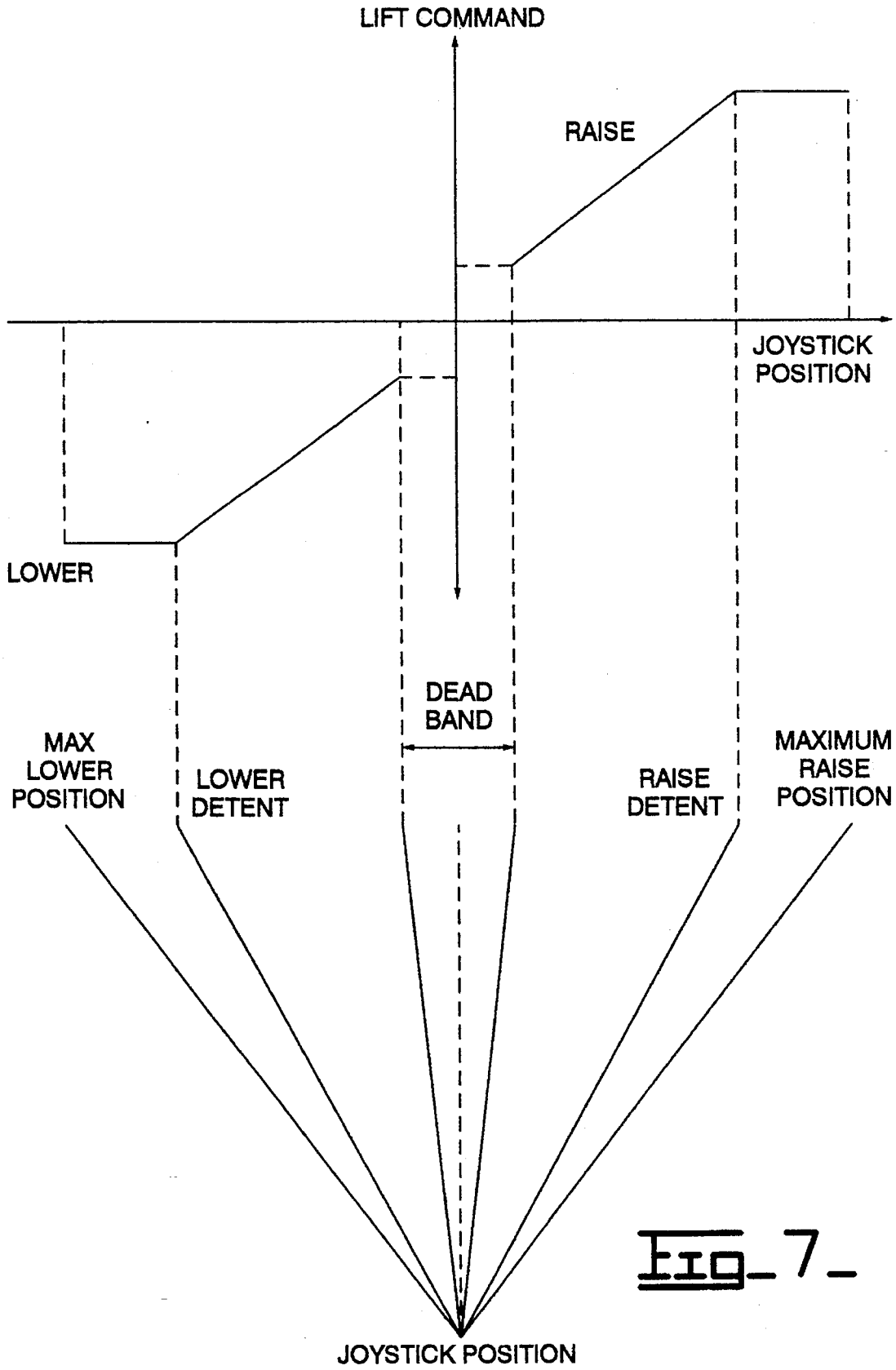
FIG. 7 is an illustration of the relationship between joystick position and lift command according to the general operation of the implement control.

With reference to the FIG. 7, the general operation of the control system will now be discussed. In the upper portion of the illustration of FIG. 7 is a graph of a joystick position versus lift command signal. The lift command signal represents the electrical signal delivered by the controlling means 308 to the valve means 302. The lower portion of the illustration represents the joystick position.

The joystick 306A is movable between its maximum lower and raise positions. Raise and lower detent positions are defined between the neutral position and the respective maximum position. A deadband area is centered on the neutral position. Generally, the operation of the control is thus: while the joystick is between the detent position and the deadband area, the lift command is a function of the joystick position. At or above detent, the lift command is substantially at a maximum raise or lower command.

The present invention provides for electrical control of the valve means over the whole range of operation. This allows flexible control and definable kickout positions. Additionally, the systems allows for modulation of the lift command at various points in the control cycle (as described below) to minimize wear on the machine.

Figure 5:
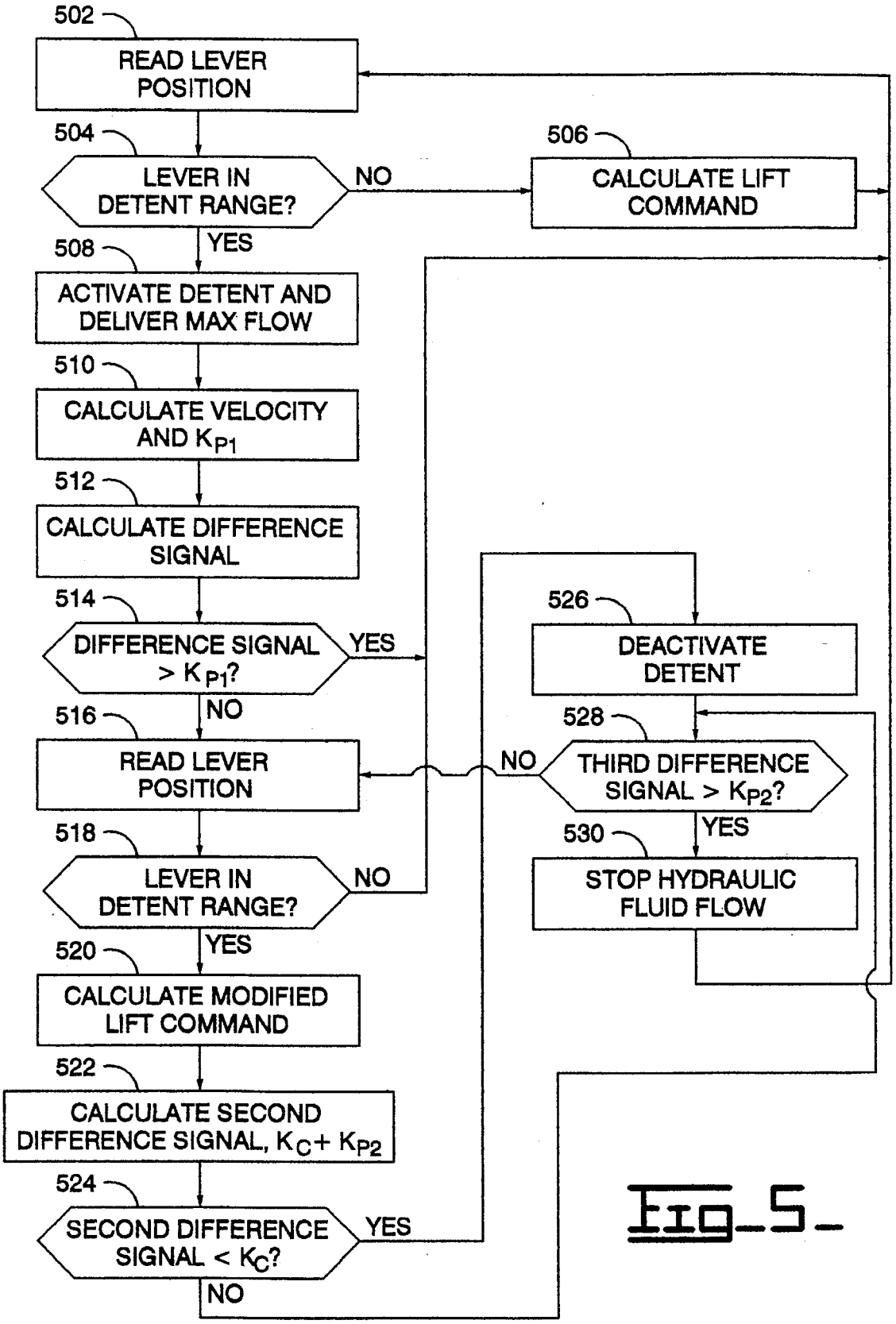
FIG. 5 is a flow diagram illustrating operation of the implement control of the present invention.

With reference to FIG. 5, the operation of the control system will be described in accordance with an embodiment of the present invention. The process described in FIG. 5 will be discussed in terms of the lift joystick and associated valve means 302A. However, it is equally applicable to the other electro-hydraulic circuits.

In a first control block 502, the lever position from the joystick position sensing means 616 is read. In a first decision block 502, if the lever position is not within either of the lever detent ranges (defined by the detent positions), control proceeds to a second control block 506. In the second control block 506, a lift command proportional to the joystick position is determined and delivered to the valve means 302. Preferably, the lift command is determined via a computer look-up table. Then control proceeds back to the first control block 502.

If in the first decision block 504, the lever is in the detent range, then in a third control block 508 the controlling means 308 activates the detent means 610 by actuating the respective solenoid 612,614, thereby holding the lever 604 in the respective detent position. Additionally, the maximum lift command os delivered to the valve means 302.

In a fourth control block 510, the controlling means 308 determines the lift arm velocity in response to recently sampled cylinder extension signals. Preferably, the lift arm velocity is calculated by differentiating the cylinder extension signal, as would be apparent to one skilled in the art. The controlling means 308 further determines a first threshold $K_{P1}$ as a function of lift arm velocity and position. The first threshold $K_{P1}$ is chosen to reflect the difference between the kickout begin-modulation-position and the associated kickout height (i.e., a modulation region). Thus, the first threshold is related to lift position and in the preferred embodiment is a function of velocity. Preferably the first threshold $K_{P1}$ is calculated to provide a substantially larger stopping distances with increasing lift arm velocity. A relatively large difference signal infers a gradual stopping of the lift arm assembly 110, whereas a relatively small difference signal infers bringing the lift arm assembly 110 to a stop in a relatively short distance. It should be appreciated that the first threshold $K_{P1}$ may also be determined in response to other sensed parameters, such as implement acceleration.

In a second decision block 514, if the difference signal is greater than $K_{P1}$, the lift arm has not reached the begin of modulation region and control returns to the first control block 502.

If the lift arm is in the begin modulation region, then the lever position is read again in a sixth control block 516. If in a third decision block 514, the joystick is not in the detent range, then control returns to the first control block 502.

In a seventh control block 520, a modulated lift command is determined and delivered to the valve means 302. The modulated lift command is preferably determined via a computer look up table. The modulation of the lift command allows the lift assembly to slow before coming to a stop at the detent position, thereby reducing machine wear.

In an eighth control block 522, a second difference signal and a second threshold $K_C$ are determined. The second threshold $K_C$ is related to the command signal to the hydraulics and is determined as a function of lift arm velocity and position. For example. the second threshold could be related to approximately ¾ of maximum command.

In a fourth decision block 524, if the second difference signal is less than $K_C$ than control proceeds to a ninth control block 526. In the ninth control block, the detent solenoids are de-energized and the lever is thus released from the detent position. Control proceeds to a fifth decision block 528.

If, in the fourth decision block 524, the second difference signal 524 was greater or equal to the second threshold ($K_C$) than control proceeds to the fifth decision block 528.

In the fifth decision block 528, if the second difference signal is less than the third threshold signal ($K_{P2}$) then the lift command is set to zero than and the hydraulic fluid flow to the hydraulic actuator stops. If the second difference signal is not less than $K_{P2}$, then control returns to the sixth control block 516. The third threshold is also dependent upon position. The third threshold may be fixed or variable.

The steps described with relation to blocks 516–530 allows the implement control to release the detent level and slowly modulate the lift command down to zero. This prevents the hydraulic flow to the hydraulic actuator to be shut off abruptly. Thus, when the difference signal is less than $K_C$ but greater or equal to $K_C$, the detent is deactivated (allowing the joystick to return to the neutral position) while the lift command is modulated down to zero. When the difference signal is less than a third threshold ($K_{P2}$), the flow to the hydraulic cylinder is stopped (lift command=0).

The process of FIG. 5 was discussed in relation to the operation of the lift arms of the lift assembly. However, the process may also be applied to the bucket. When so applied to the bucket, a single detent controls operation of the bucket to a rack-back or tilt-back position. This operation may be modulated or un-modulated.

The flexibility of the full electronic implement control enables other functions to be provided. For example, the implement control provides a "feather catch" operation during gravity assisted operation such as lowering of the lift arms and dumping of the bucket contents.

Additionally, the full electronic implement control provides better control over other features of the hydraulics. For example, to compensate hydraulic cylinder cavitation (the result of the hydraulics being unable to supply adequate hydraulic fluid flow during a gravity assisted function such as lowering of a full bucket) the return to tank flow may be partially re-routed to the supply circuit. The full electronic control allows this feature to be more efficiently controlled only when desired.

The full electronic implement control allows complete control over the implement's work cycle. For example, although typically it is desirable to modulate the command to the hydraulics between the kickout position and to a position less than the maximum position, it may, at times, be advantageous to allow the operator to operate the implement beyond this position. This allows the operator, for example, to clear the bucket of any material remaining by allowing the operator to move the linkage until it hits the mechanical stops.

The full electronic implement control system is also adapted to provide cushioned stop before the mechanical stops. This is known as snubbing.

Feather Catch

Figure 8:
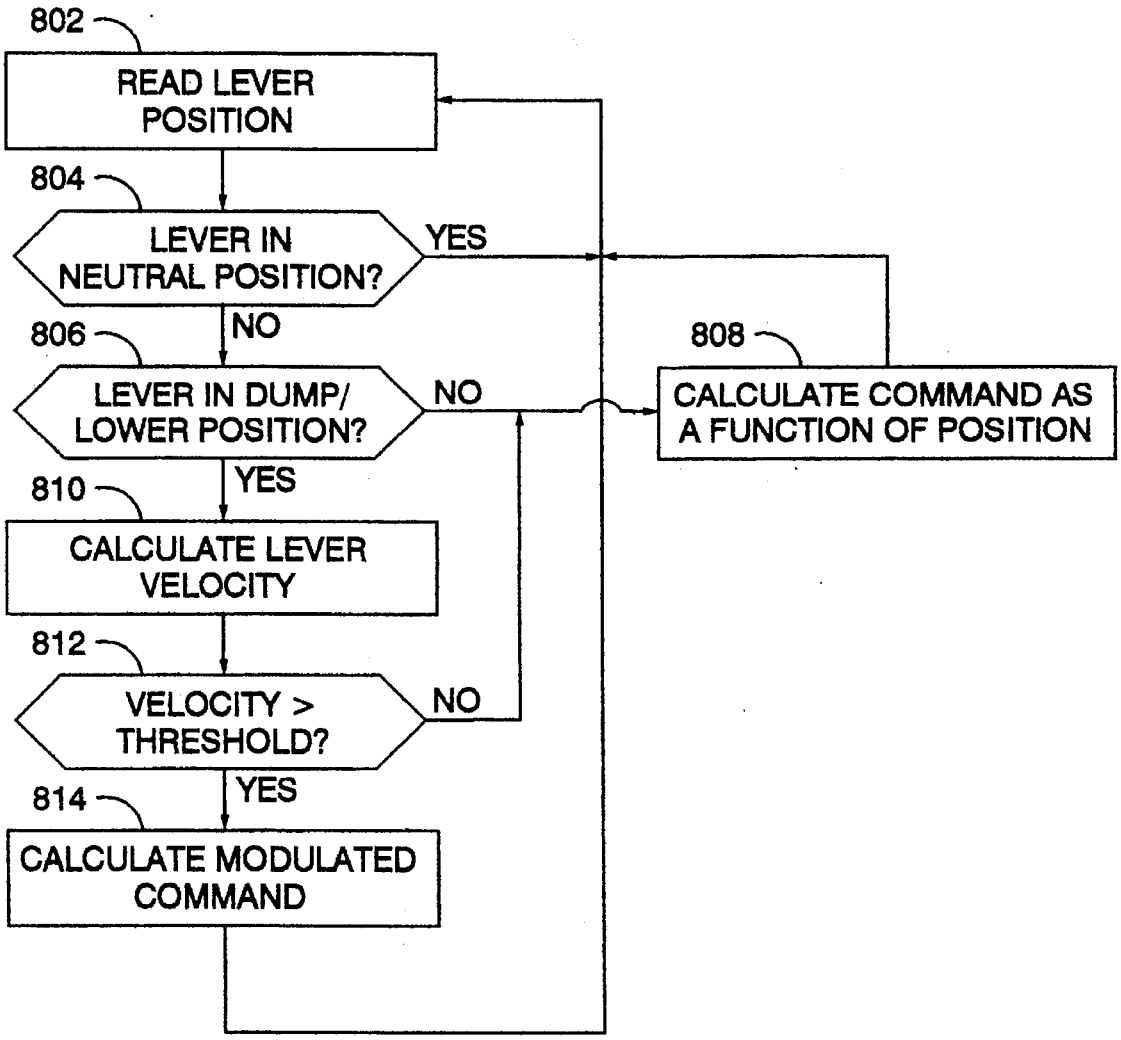
FIG. 8 is a flow diagram illustrating operation of a cushioned catch feature of the implement control according to the embodiment of the present invention.

With respect to FIG. 8, operation of the full electronic implement control is illustrated according to a preferred embodiment of the present invention. In a first control block 802 the control lever position is read. In a first decision block 804, if the lever is in the neutral position, then control returns to control block 802. If the lever is not in neutral, then control proceeds to a second decision block 806. If the lever is not in neutral, then control proceeds to a second decision block 806.

If, in the second decision block 806, the lever is in a dump or lower position, then control proceeds to a second control block 808. In the second control block 808, the command signal to the hydraulics is calculated as a function of the control lever position. If the control lever is in the dump or lower position, then control proceeds to a third control block 810.

In the third control block, the lever velocity is calculated as the derivative of the position. In a third decision block 812, if the velocity is greater than a threshold, then control proceeds to a fourth control block 814. If the velocity is not greater than the threshold, then control proceeds to the second control block 808.

In the fourth control block 814, a command is generated which modulates the valve from an open position to the closed position. The modulation is dependent upon the hydraulic and cylinder characteristics. The modulation prevents the hydraulics from too quickly stopping the lift or dump operation. This prevents and reduces stress on the system components.

Cavitation Compensation

During gravity assisted functions, for example, lowering of the lift arm assembly, the hydraulic system may not be able to supply adequate hydraulic fluid flow to the head end of the hydraulic cylinder. This condition may cause instabilities in the system and may result in "jerky" operation.

Figure 9:
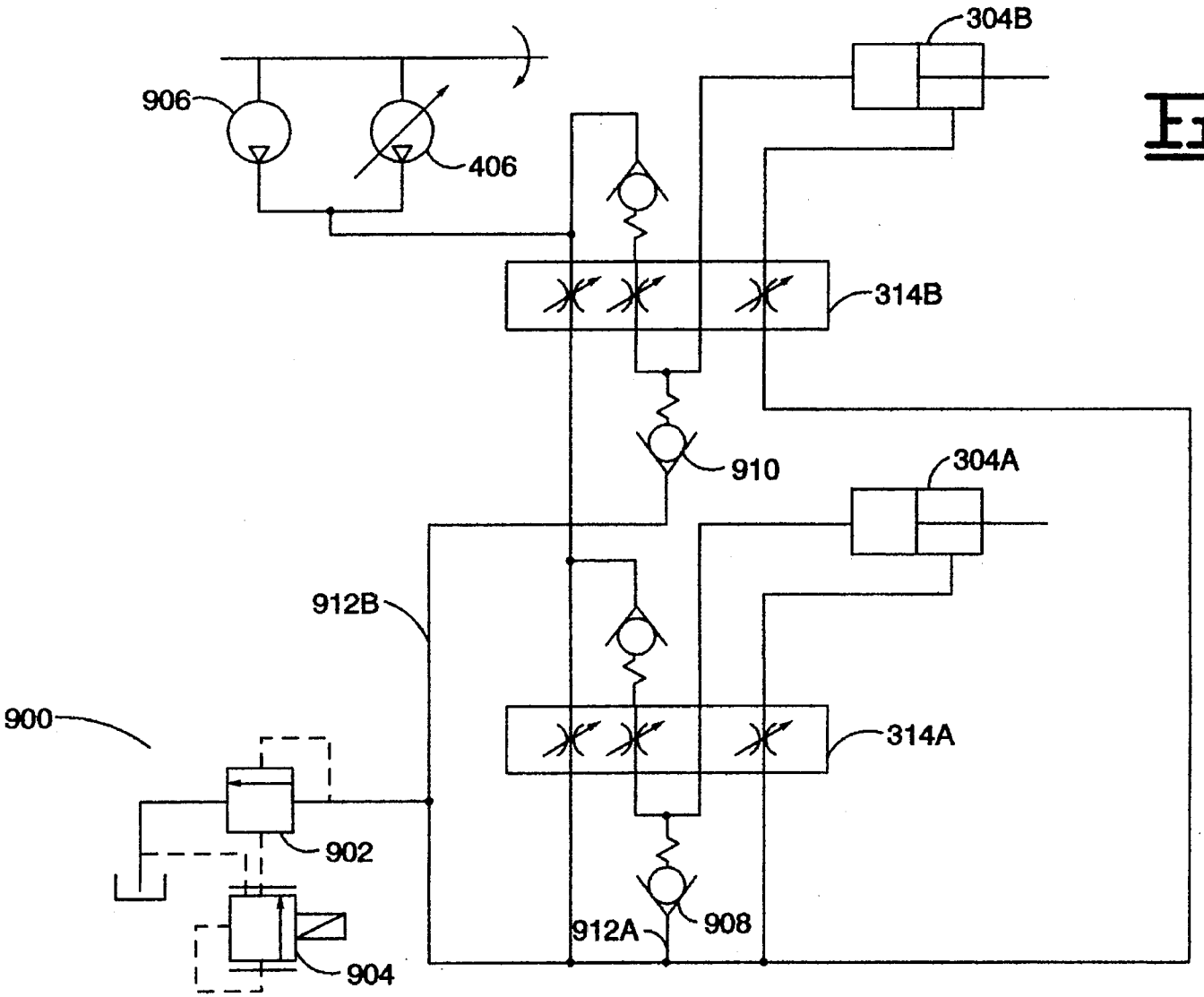
FIG. 9 is a diagrammatic illustration of a portion of the present invention used to compensate for cylinder cavitation.

With respect to FIG. 9 in the preferred embodiment, a tank restrictor means 900 is place between the hydraulic circuit and the reserve tank (in the return to tank circuit. In the circuit, the control valves 314A, 314B are represented by symbols representing their respective stems. The stems thus (in a simplified form) illustrate the internal flow of hydraulic fluid. It should thus be noted that the present invention is not limited to any such stem design and is equally applicable to other designs.

In the preferred embodiment, the tank restrictor means 900 includes a tank restrictor valve 902 and a tank restrictor valve solenoid. The tank restrictor valve 902 is actuatable via the solenoids 904 and restricts flow back to the tank in response to actuation. A hydraulic path 912A,912B is provided from the return to tank line to each control valve 314A, 314B. A lift check valve 908 and a tilt check valve 910 connect the respective pathway to the respective control valve 912A,912B.

In the preferred embodiment whenever a gravity assisted operation is desired, the controlling means 308 actuates the tank restrictor valve 902 via the tank restrictor valve. The pathways 912A, 912B and the respective check valves 908,910 provide additional hydraulic flow which is added to the hydraulic flow added by the pumps 906, 406 to make-up the flow in the head ends of the cylinders 304A,304B.

Snubbing

Figure 10:
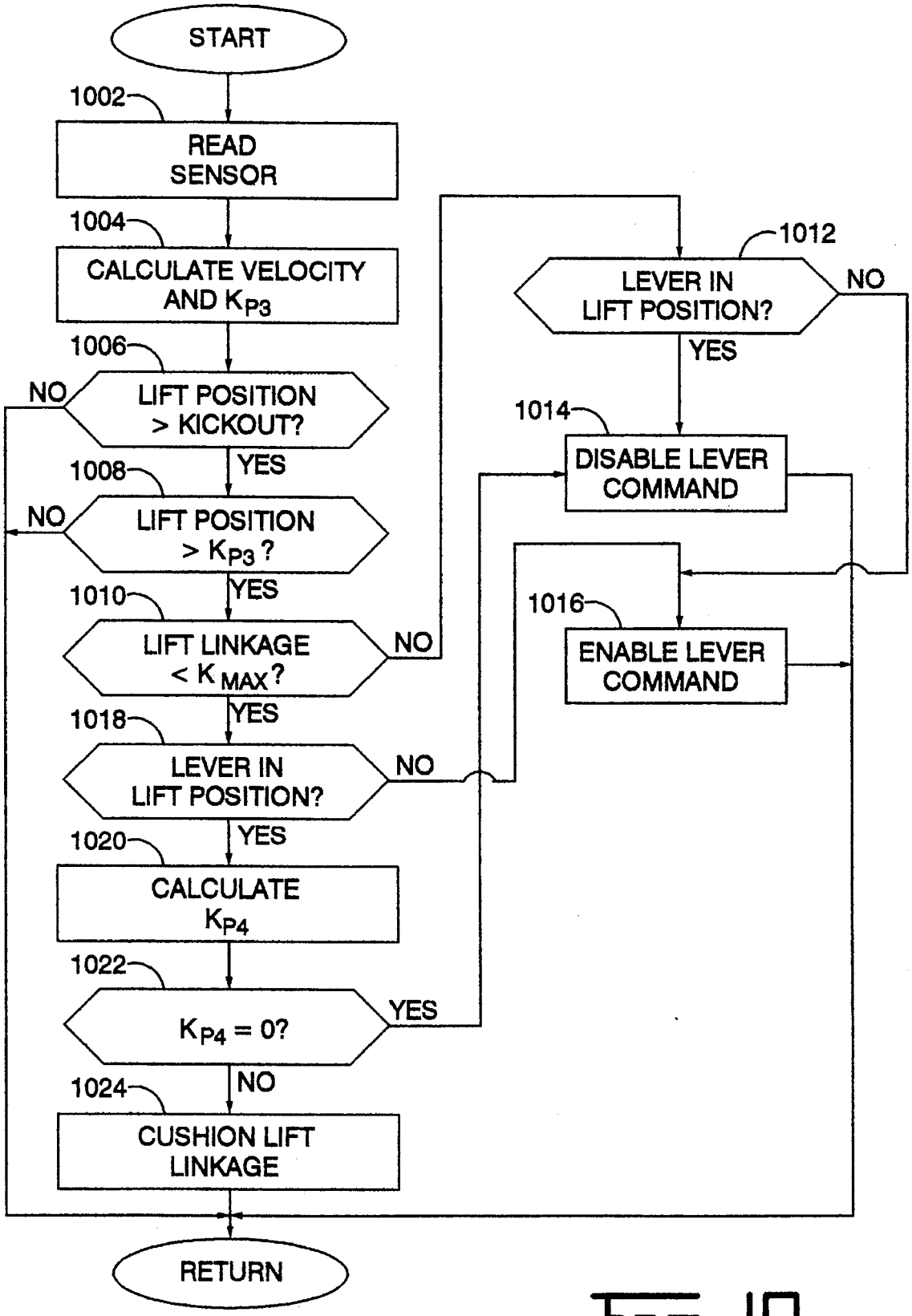
FIG. 10 is a flow diagram illustrating operation of the implement control of the present invention during snubbing.

With reference to FIG. 10, operation of the present invention during the snubbing feature will now be discussed. In a first control block 1002, the lever control position and the linkage position sensors are read. In a second control block 1004, the velocity of the linkage is determined as a function of the linkage position and a constant, $K_{P3}$, is determined. $K_{P3}$ is the difference between the maximum mechanical lift linkage position and the snub cushioning length. The snub cushioning length is a function of the linkage velocity and is the length used to modulate the lift command down to zero.

In a first decision block 1006, of the current lift position is not greater than the kickout position then the control routine ends. If the current lift position is greater than the kickout position then control proceeds to a second decision block 1008. In the second decision block 1008, if the lift position is greater than $K_{P3}$ control proceeds to a third decision block 1010. Otherwise, the control routine ends.

In the third decision block 1010, if the lift linkage is not less than a maximum ($K_{max}$) then control proceeds to a fourth decision block 1012. In the fourth decision block 1012, if the lever is in the lift position then operator control of the lift command is disabled. Otherwise, operator control of the lift command is enabled. Thus if the control is performing snubbing, the lift command is no longer a function of the lever position. During snubbing, the control is gently bring the linkage to a stop at the mechanical stop. The lift command is a function of linkage velocity and position.

If in the third decision block 1010, the lift linkage is less than $K_{max}$ then control proceeds to a fifth decision block 1018. In the fifth decision block 1018, if the lever is not in the lift position then the lever command is enabled and the routine is exited. If however, the lever is in the lift position, then control proceeds to a third control block 1020. In the third control block 1020, an error signal $K_{P4}$ is determined. $K_{P4}$ is the error distance between the maximum position (Max) and the current position. If $K_{P4}$ is equal to zero (in the sixth decision block 1022) then the linkage has reached the mechanical stop and movement stops (lift command will also be zero).

If $K_{P4}$ is not zero than control proceeds to a fourth control block 1024. In the fourth control block, the lift command is determined as a function of the linkage's current position, the error distance, and $K_{P4}$. In the preferred embodiment, the new lift command is determined by:

$$\text{starting lift command}=(K_{P4}/(K_{Max}-K_{P3}).$$

INDUSTRIAL APPLICABILITY

Vehicles such as wheel type loaders include work implements capable of being moved through a number of positions during a work cycle. The typical work cycle associated with a bucket includes positioning the bucket and associated lift arm assembly in a digging position for filling the bucket with material, a carrying position, a raised position, and a dumping position for removing material from the bucket.

The present invention provides a method and apparatus for progressively slowing the velocity of the implement during a work cycle rather than abruptly stopping or changing the velocity of the implement. Such a function is particularly worthwhile to slow the implement before it reaches a kickout position and to slow the implement before a mechanical stop impacts a portion of the lift arm assembly or lift cylinders.

The present invention also provides a full electronic implement control system. That it, the work implement is controlled via electronic joysticks which deliver electronic signals to the controlling means. The controlling means actuates a valve means, thereby controllably providing hydraulic fluid to the hydraulic actuators. This allows, the hydraulic system to be fully insulated from the operator cab.

It should be understood that while the function of the preferred embodiment is described in connection with the lift arm assembly and associated hydraulic circuits, the present invention is readily adaptable to control the position of other types of implements. For example, the present invention could be employed to control implements on hydraulic excavators, backhoes, and similar vehicles having hydraulically operated implements.

Other aspects, objects, and advantages of this invention can be obtained from a study of the drawings, the disclosure, and the appended claims.

We claim:

1. A method for controllably providing a feather-catch function for an implement, the implement being connected to a work machine and being movable between maximum and minimum implement positions in response to operation of a hydraulic actuator, comprising:

(a) sensing the position of a joystick and responsively producing a joystick position signal;

(b) if said joystick position signal is in a raise range, delivering hydraulic fluid flow to the hydraulic actuator as a function of said joystick position signal;

(c) if said joystick position signal is in a lower range:

(c)(1) calculating joystick velocity as a function of said joystick position signal and responsively producing a joystick velocity signal;

(c)(2) comparing said joystick velocity signal to a predetermined threshold, said predetermined threshold selected to prevent the implement from being lowered too fast; and (c)(3) delivering hydraulic fluid flow to the hydraulic actuator as a function of said joystick position signal if said joystick velocity signal is not greater than said predetermined threshold; and (c)(4) delivering modulated hydraulic fluid flow to the hydraulic actuator to lower and then stop the implement at a safe speed if said joystick velocity signal is greater than said predetermined threshold; and, (d) returning to step (a).

* * * * *